US009828773B2

(12) United States Patent
Imai et al.

(10) Patent No.: US 9,828,773 B2
(45) Date of Patent: Nov. 28, 2017

(54) COLUMN END JOINT STRUCTURE

(71) Applicant: Sumitomo Forestry Co., Ltd., Tokyo (JP)

(72) Inventors: Junichi Imai, Tokyo (JP); Hiroshi Takashima, Tokyo (JP); Hiroki Nakashima, Tokyo (JP)

(73) Assignee: Sumitomo Forestry Co., Ltd., Tokyo (JP)

( * ) Notice: Subject to any disclaimer, the term of this patent is extended or adjusted under 35 U.S.C. 154(b) by 0 days.

(21) Appl. No.: 15/061,009

(22) Filed: Mar. 4, 2016

(65) Prior Publication Data

US 2016/0258161 A1 Sep. 8, 2016

(30) Foreign Application Priority Data

Mar. 5, 2015 (JP) ..... 2015-043684

(51) Int. Cl.
*E04C 3/36* (2006.01)
*E04B 1/38* (2006.01)
(Continued)

(52) U.S. Cl.
CPC ..... *E04C 3/36* (2013.01); *E04B 1/26* (2013.01); *E04B 1/38* (2013.01); *E04H 9/021* (2013.01);
(Continued)

(58) Field of Classification Search
CPC ..... E04B 1/26; E04B 1/38; E04B 2001/2648; E04B 2001/268; E04B 2001/2684;
(Continued)

(56) References Cited

U.S. PATENT DOCUMENTS 1,486,152 A * 3/1924 Mascio ..... E04B 1/04 52/285.2
2,126,511 A * 8/1938 Soule ..... E04B 2/58 52/223.6
(Continued)

FOREIGN PATENT DOCUMENTS

JP 2006118254 A * 5/2006
JP 2007077611 A * 3/2007
(Continued)

OTHER PUBLICATIONS

Machine translation of Foreign reference JP 2006-118254A, obtained from https://www4.j-platpat.inpit.go.jp/cgi-bin/tran_web_cgi_ejje?u=http://www4.j-platpat.inpit.go.jp/eng/translation/201701180502562691535649755045810745C0240F3D14A6C969-84436C59304DB5 (last accessed on Jan. 18, 2017).*
(Continued)

*Primary Examiner* — Theodore Adamos
(74) *Attorney, Agent, or Firm* — The Webb Law Firm

(57) ABSTRACT

In a column end joint structure for joining an end of a column made of flat wooden material having a rectangular cross-section to a joining member, splitting generation at the end of the column is controlled. An expansion of crack is controlled when splitting generated. A cutout portion is provided in each of ends in a longitudinal direction of a column end face, and a joint fitting is coupled inside the cutout portion by a joint bolt. The joint fitting is coupled to a foundation by an anchor bolt. Joint fittings are arranged in the longitudinal direction of the end face inside each cutout portion. One joint fitting is located contacting or close to a surface of the column inside the cutout portion such that the joint fitting side face and the surface of the column inside the cutout portion restrain a displacement orthogonal to the column axis.

2 Claims, 10 Drawing Sheets

(51) Int. Cl.
*E04H 9/02* (2006.01)
*E04B 1/26* (2006.01)

(52) U.S. Cl.
CPC . *E04B 2001/266* (2013.01); *E04B 2001/2684* (2013.01); *E04B 2001/2692* (2013.01)

(58) Field of Classification Search
CPC ..... E04B 2001/2696; E04B 1/215; E04B 2001/2652; E04B 2001/266; E04B 2001/2692; E04C 3/36; E04H 9/021
USPC ..... 52/272, 274, 281, 282.2, 283, 285.2, 52/285.1, 167.1, 167.3, 167.4, 79.12, 52/79.13; 403/343
See application file for complete search history.

(56) References Cited

U.S. PATENT DOCUMENTS 3,884,002 A * 5/1975 Logie ..... E04B 1/6162 312/263
4,321,776 A * 3/1982 Delight ..... C30B 1/023 52/167.1
6,298,612 B1 * 10/2001 Adams ..... E04B 1/26 52/167.3
6,920,724 B1 * 7/2005 Hundley ..... E04B 1/24 52/167.3
2003/0041551 A1 * 3/2003 Boone ..... E04B 1/26 52/698
2003/0205011 A1 * 11/2003 Bequet ..... B64C 1/12 52/272
2006/0144008 A1 * 7/2006 Fouch ..... E04B 1/26 52/292
2009/0173019 A1 * 7/2009 Pryor ..... E02D 27/42 52/167.4
2010/0251637 A1 * 10/2010 Nishimoto ..... E04H 9/021 52/167.8
2012/0304587 A1 * 12/2012 Kenho ..... E04H 9/021 52/699
2013/0199123 A1 * 8/2013 Junes ..... E04B 1/215 52/707
2014/0093306 A1 4/2014 Imai et al.

FOREIGN PATENT DOCUMENTS

JP 2008255627 A * 10/2008
JP 2013204228 A 10/2013

OTHER PUBLICATIONS

Machine translation of Foreign reference JP 2007-077611A, obtained fromhttps://www4.j-platpat.inpit.go.jp/cgi-bin/tran_web_cgi_ejjeu=http://www4.j-platpat.inpit.go.jp/eng/translation/20170118052951891153581131372706084 5C0240F3D14A6C969-84436C59304DB5 (last accessed on Jan. 18, 2017).*
Machine translation of Foreign reference JP 2008-255627A, obtained from https://www4.j-platpat.inpit.go.jp/cgi-bin/tran_web_cgi_ejjeu=http://www4.j-platpat.inpit.go.jp/eng/translation/20170118055627616153597088282402734 5C0240F3D14A6C969-84436C59304DB5 (last accessed on Jan. 18, 2017).*

* cited by examiner

COLUMN END JOINT STRUCTURE

CROSS-REFERENCE TO RELATED APPLICATION

This application claims priority to Japanese Patent Application No. 2015-043684 filed Mar. 5, 2015, the disclosure of which is hereby incorporated in its entirety by reference.

BACKGROUND OF THE INVENTION

1. Technical Field

The present invention relates to a column end joint structure for joining a wooden column to a joining member (member to be joined) such as a wooden beam and a foundation in a wooden building, and more particularly to a column end joint structure in which transmission of a bending moment is facilitated between the column and the joining member.

2. Related Art

In a wooden building, it is proposed to adopt a Rahmen structure (rigid-frame structure) as a structural framework in which a joining between a wooden column and a wooden beam or that between a wooden column and a foundation is implemented by a so-called rigid coupling which is capable of transmitting a bending moment. With such a structure, when forces in a horizontal direction act on the structure repeatedly in a reciprocating manner such as during an earthquake, the bending moment and shearing force are generated at a joint portion between the column and the beam or at a joint portion between the column and the foundation. Further, the structural framework will have high quake resistance if these joint portions are equipped with sufficient strength against the bending moment and the shearing force generated at the time of an earthquake.

A joint structure for a Rahmen structure that employs wooden columns is disclosed, for example, in Patent Literature 1.

In this joint structure, at two positions on an end of a wooden column, the column is joined to a beam or a foundation via respective joint fittings, and the joint structure is configured as described below.

The column has a flat shape wherein a length of one side of a rectangular cross-section thereof is larger than a length of an adjacent another side. At an end of this column, a rectangular cutout is provided in each of both ends in a longitudinal direction of an end face. A screw member is threaded into the column in an axial direction thereof from inside the cutout. A bolt hole extending the axial direction from the end face is formed in this screw member. The joint fitting is arranged inside the above-mentioned cutout portion provided in the column, and is attached to the column by a bolt which is threaded into the bolt hole from the end face of the screw member. Further, this joint fitting is coupled to the foundation or the beam that is to be joined to the column by the bolt.

In such a joint structure, the column resists the bending moment with tensile force which is transmitted from the column via the screw member, the bolt, and the joint fitting to the foundation or the beam and with compression force which is transmitted from the column via the joint fitting to the foundation or the beam. Further, the bolt which is threaded into the screw member and couples the joint fitting and the column, and the bolt which couples the joint fitting and the foundation or the beam mainly resists shearing force.

[Patent Literature 1] JP-A-2013-204228

However, with such a joint structure as described above, the following problem may occur when a high bending moment and high shearing force act on it.

At the joint portion between the column and the foundation or that between the column and the beam, splitting stress acts in the column when the high bending moment and the high shearing force act on the joint portion. In other words, the force that causes generation of a crack along the axial direction of the column acts on the wooden column at the portion where the screw member is threaded into the column. While the screw member and the bolt for coupling the joint fitting are effective for resisting the bending moment when being threaded into the column at a position in the vicinity of the both ends in the longitudinal direction of the cross-section of the column, splitting tends to be generated more easily when the screw member and the bolt are threaded into the column at a position in the vicinity of the both ends in the longitudinal direction of the cross section of the column. When the splitting is generated at the position where the screw member has been threaded into the column, there arises a possibility of degradation of resistance of the joint portion against the bending moment and the shearing force.

Such a problem occurs not only in a case where the screw member is threaded into the wooden column and then the bolt is threaded from the end face thereof to fix the joint fitting, but also occurs in a similar manner in a case where the joint fitting is fixed to the column via a bolt, a rod-shape member, or the like inserted in the vicinity of an end edge.

The present invention has been made in view of above circumstances, and it is therefore, a purpose of the present invention is to provide a column end joint structure that can control generation of the splitting at an end of a column made of wooden material and that can control expansion of a splitting width even when the splitting is generated.

SUMMARY OF THE INVENTION

To solve the problem, the invention according to Aspect 1 provides a column end joint structure for joining an end of a column made of a flat wooden material having a substantially rectangular cross-section, a length of one side thereof being larger than a length of an adjacent another side, to a joining member which is another member, wherein a cutout portion is provided in each of both ends in a longitudinal direction of an end face of the column; a joint fitting is coupled to the column by a joint bolt inserted in an axial direction of the column inside the cutout portion; the joint fitting is coupled to the joining member; a plurality of the joint fittings are arranged in the longitudinal direction of the end face of the column inside each of the cutout portions; and one of the joint fittings is located at a position in contact with or close to a surface in the axial direction of the column inside the cutout portion such that a side face of the joint fitting and the surface in the axial direction of the column inside the cutout portion restrain a relative displacement in a direction orthogonal to the axis of the column. Here, "substantially rectangular" means that the cross-sectional shape does not necessarily have to be strictly rectangular as long as the wooden material functions as a column that forms the structure. For example, it is substantially rectangular as long as the cross-sectional shape can be regarded as rectangular as a whole even if a corner thereof may be chamfered or rounded. Further, also in the case where the shape is simply referred to as being "rectangular" instead of being "substantially rectangular," the shape does not necessarily have to be strictly rectangular. In other words, it is sufficient if the shape can be regarded as rectangular as a whole, as long as the wooden material functions as a column, or in the case of a cutout, as long as the cutout produces an effect intended by the present invention. The same applies when reference substantially is made to a rectangular box or a rectangular space, or the like.

In this column end joint structure, when the bending moment that generates a tensile region and a compression region in the longitudinal direction of the column end face acts thereon, tensile force and compression force are transmitted to the joining member mainly via the joint fittings arranged in the vicinity of the end edges of the column end face. On the other hand, shearing force that acts on the end of the column is distributed among a plurality of joint bolts that are arranged in the longitudinal direction of the column end face and inserted or pierced into the column. Then, the shearing force is transmitted from the respective joint bolts to the joining member via the joint fittings. At this time, splitting force acts along the joint bolts inserted into the column. The splitting is less likely to be generated at a central side of the column compared to positions along the joint bolts inserted in the vicinity of the both ends in the longitudinal direction of the column end face. Accordingly, the joint bolts inserted in the vicinity of the both ends in the longitudinal direction of the column end face and the joint fittings joined thereto mainly resist the bending moment, and the joint bolts inserted into the central side of the column and the joint fittings joined thereto mainly resist the shearing force, improving resistance of the joint portion at the column end thereby.

Further, when displacement of the column occurs with respect to the joint fitting as a result of generation of the splitting or increase of an amount of deformation of the column made of wooden material, the end portion of the column protruding in the axial direction between two cutout portions is pressed against the joint fittings arranged in contact therewith or in the vicinity thereof such that displacement is restrained. Thus, the amount of deformation in the horizontal direction until final breakage occurs at the joint portion of the column end is limited to a small value, and the resistance until final breakage is improved.

The invention according to Aspect 2 provides a column end joint structure for joining an end of a column made of a flat wooden material having a substantially rectangular cross-section, a length of one side thereof being larger than a length of an adjacent another side, to a joining member which is another member, wherein a cutout portion is provided in each of both ends in a longitudinal direction of an end face of the column; inside each cutout portion, a plurality of joint bolts are arranged in the longitudinal direction of a cross-section of the column and inserted in an axial direction of the column to couple a joint fitting; the joint fitting is coupled to the joining member by the plurality of bolts arranged in the longitudinal direction of the cross-section of the column; and the joint fitting is located at a position in contact with or close to a surface in the axial direction of the column inside the cutout portion such that a side face of the joint fitting and the surface in the axial direction of the column inside the cutout portion restrain a relative displacement in a direction orthogonal to the axis of the column.

In this column end joint structure, when the bending moment that generates a tensile region and a compression region in the longitudinal direction of the column end face acts thereon, the tensile force is transmitted from the joint bolts inserted into the column to the joining member mainly via the joint fitting arranged in the vicinity of the end edge in the longitudinal direction of the column end face. On the one hand, the shearing force acting on the end of the column is distributed among the plurality of joint bolts that are arranged in the longitudinal direction of the column end face and inserted into the column and transmitted to the joint fitting. Accordingly, the splitting is less likely to be generated at the end portion of the column, and the deformation amount is limited to a small value even when the splitting is generated.

Further, when displacement of the column occurs with respect to the joint fitting as a result of generation of the splitting or increase of an amount of deformation of the column made of wooden material, the end portion of the column protruding in the axial direction between two cutout portions is pressed against the joint fittings fixed to the joining members by a plurality of bolts such that displacement is restrained. Thus, the amount of deformation in the horizontal direction until final breakage occurs at the joint portion of the column end is limited to a small value, and the resistance until final breakage is improved.

The invention according to Aspect 3 is the column end joint structure according to Aspect 1 or 2, wherein a screw member having a spiral blade body on an outer peripheral surface of a rod-shape shaft portion and a hollow hole in the axial direction from an end face of the shaft portion is threaded into the axial direction of the column from inside the cutout portion; the joint bolt is inserted into the hollow hole in the screw member; and the joint bolt is threaded into an internal thread formed in a bottom portion of the hollow hole.

In this column end joint structure, when the bending moment acts on the joint portion between the column and the joining member, the tensile force acts on the joint bolt on the tensile side over a wide range between a portion coupled to the joint fitting and a portion threaded into the internal thread (female thread) portion inside the hollow hole in the screw member. Then, when a degree of tensile stress exceeds a degree of yield stress, plastic deformation is generated in this range. Accordingly, the displacement of the column end is limited to a small value with respect to the shearing force while a large deformation is permitted until final breakage with respect to the bending moment. As a result, vibration energy at the time of an earthquake can be absorbed, and thus safety with respect to the final breakage is improved by this tenacious structure.

The invention according to Aspect 4 is the column end joint structure according to any one of Aspect 1 to 3, wherein at the end of the column, a long screw is threaded from a short side face of a column cross-section into the longitudinal direction of the cross-section; and a tip of the long screw crosses the joint bolts inserted in the axial direction of the column and reaches a position exceeding positions of the joint bolts.

In this column end joint structure, the column can be fastened in a direction orthogonal to the axis by a long screw. Accordingly, generation of a crack in the axial direction at a position where the joint bolt is inserted can be controlled.

Effect of the Invention

As described above, the column end joint structure according to an embodiment of the present invention can control generation of a crack at an end of a column made of wooden material and can control widening of the crack width even when a crack is generated.

The present invention will become more fully understood from the detailed description given hereinbelow. The other applicable fields will become apparent with reference to the detailed description given hereinbelow. However, the detailed description and the specific embodiment are illustrated of desired embodiments of the present invention and are described only for the purpose of explanation. Various changes and modifications will be apparent to those ordinary skilled in the art on the basis of the detailed description.

The applicant has no intention to give to public any disclosed embodiments. Among the disclosed changes and modifications, those which may not literally fall within the scope of the patent claims constitute, therefore, a part of the present invention in the sense of doctrine of equivalents.

DETAILED DESCRIPTION OF THE PREFERRED EMBODIMENTS

Description is hereinafter made of embodiments of the present invention with reference to the drawings.

Figure 1:
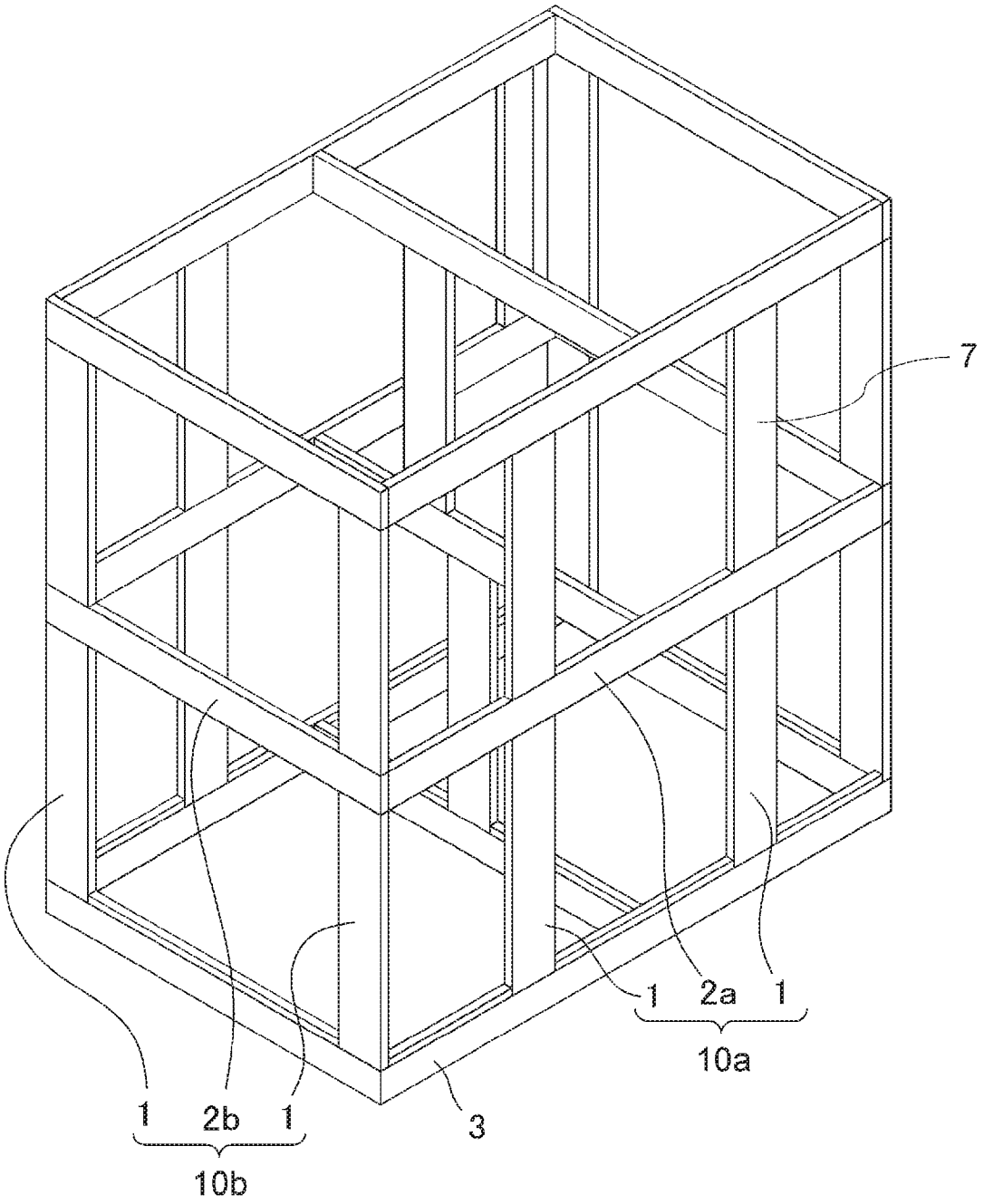
FIG. 1 is a schematic perspective view of an example of a structural framework of a wooden building in which a column end joint structure according to an embodiment of the present invention is preferably adopted.

FIG. 1 shows a schematic perspective view of a structural framework of a wooden building in which a column end joint structure according to an embodiment of the present invention is preferably adopted.

This structural framework includes a Rahmen frame 10 in which a wooden column 1, a wooden beam 2, and a foundation 3 are joined such that a bending moment is transmittable between the wooden column 1 and the wooden beam 2, as well as between the wooden column 1 and the foundation 3. This structural framework is formed by combining a plurality of Rahmen frames 10 on the concrete foundation 3. Each Rahmen frame 10 has a so-called beam-priority frame structure in which the wooden beam 2 is placed on the wooden column 1 to be joined thereto. A cross-sectional shape of the column 1 which configures each Rahmen frame 10 is flat and rectangular, long on a side in an axial direction of the beam 2 supported thereby and short on a side in a direction orthogonal to an axis of the beam 2. In addition, a cross-sectional shape of the beam 2 is also flat and rectangular, long in a vertical direction and short in a horizontal direction. Accordingly, a joint portion between the column 1 and the beam 2 in each Rahmen frame has such a structure where the joint portion mainly resists bending in only one direction which generates a compression region and a tensile region in a longitudinal direction of the cross-section. In addition, as to a Rahmen frame 10*a* and another Rahmen frame 10*b*, an end face of a beam 2*a* of the one Rahmen frame 10*a* abuts a side face of a beam 2*b* of the other Rahmen frame 10*b* to be joined therewith, and thus a three-dimensional Rahmen structure is obtained.

Figure 2:
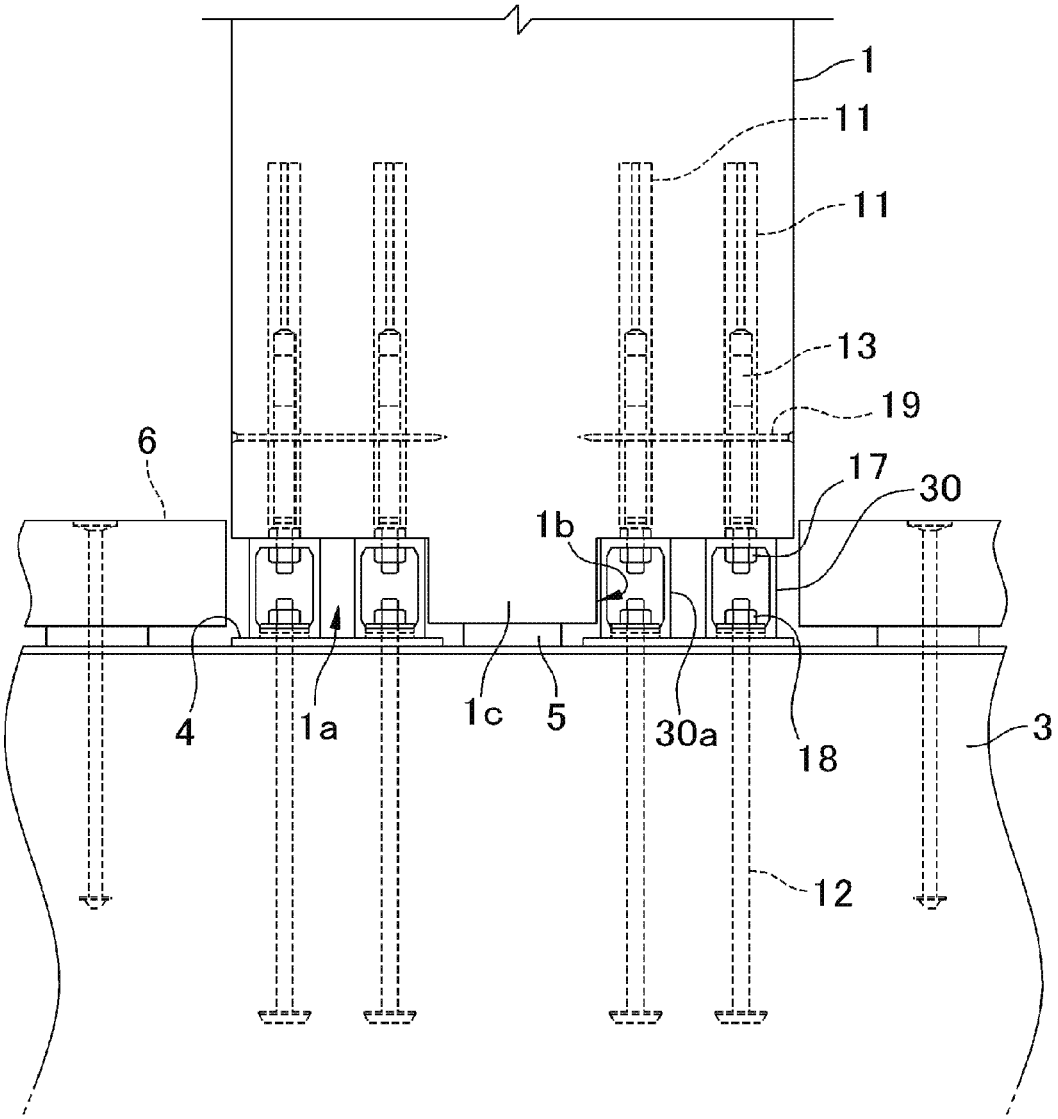
FIG. 2 is a front view, illustrating a column end joint structure according to one embodiment of the present invention.

FIG. 2 is a front view, showing a joint structure according to one embodiment of the present invention. Further, FIG. 3 is an exploded perspective view of the same joint structure.

This joint structure is for joining a lower end of the column 1 to the foundation 3, as a joining member of the column 1, via a joint fitting 30.

A cutout portion 1*a* is provided on each of both ends in the longitudinal direction of a lower end face of the column 1, and two screw members 11 are threaded into the column 1 in the axial direction thereof from each cutout portion 1*a*. These cutout portions 1*a* are formed by cutting out portions that are substantially shaped as rectangular parallelepipeds from both ends in the longitudinal direction of the end face of the column 1 into the axial direction of the column 1. In other words, both corners at ends on a wider side face of the column 1 are cut out rectangularly. The two screw members 11 are threaded into the column 1 from a surface substantially orthogonal to the axis of the column inside the cutout portions into the axial direction, the two screw members 11 being arranged in the longitudinal direction of the cross-section of the column 1. Further, the two joint fittings 30 are arranged in the longitudinal direction of the cross-section of the column in each cutout portion 1*a*, and each of these joint fittings is coupled to the respective screw members 11 with joint bolts 13.

Figure 3:
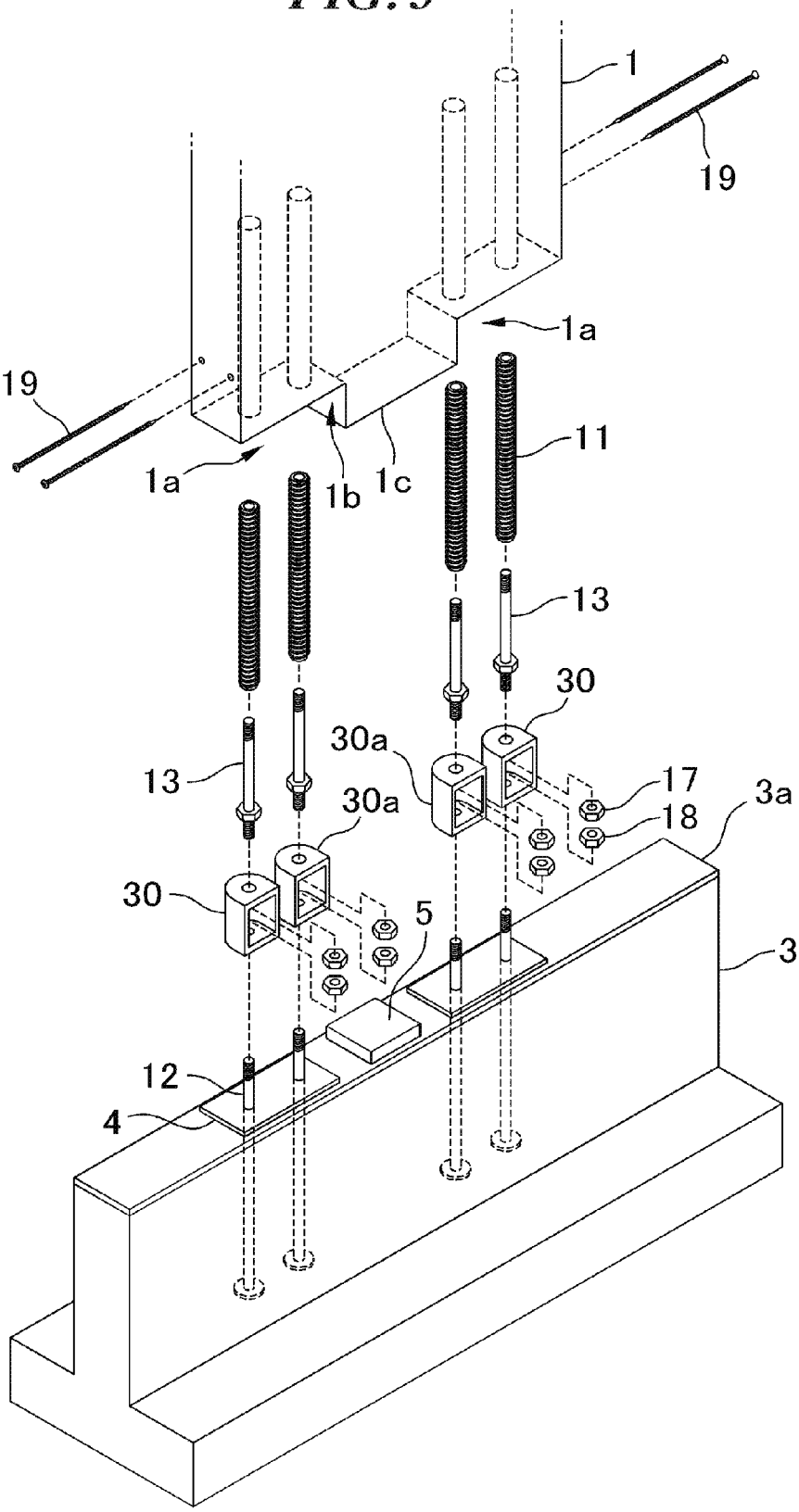
FIG. 3 is an exploded perspective view of the column end joint structure illustrated in FIG. 2.

As shown in FIG. 2 and FIG. 3, each of long screws 19 is threaded into the column 1 in a direction substantially orthogonal to the axis of the column from a narrower side face, at a position of a predetermined distance in the axial direction of the column from the end face inside the cutout portions into which the screw members 11 are threaded. The long screws 19 are threaded into both sides of the screw members 11 threaded into the column 1, and each of the long screws 19 has a length sufficient to cross with both of the two screw members 11 threaded into the column in a state arranged in the longitudinal direction of the cross-section. Here, the long screw 19 crossing the screw member 11 refers to a state where the long screw 19 is threaded into the column 1 in the direction crossing the screw member 11, as shown in FIG. 3, and the long screw 19 is long enough to reach a position exceeding the positions of the joint bolts 13 or the screw member 11, as seen on the front view shown in FIG. 2. In effect, as shown in FIG. 3, the long screw 19 is threaded into the column 1 so as to pass through a space between the screw member 11 and a wider side face of the column 1.

On the one hand, anchor bolts 12 in the vertical direction are embedded in the foundation 3 at positions corresponding to the positions into which the respective screw members 11 of the column 1 are threaded. Head portions of the anchor bolts 12 are protruding from an upper surface of the foundation 3. The upper surface of the foundation 3 is finished to be flat by a surface preparation material 3*a*, and the joint fittings 30 are supported thereon via steel base plates 4. Further, the joint fittings 30 are fixed to the foundation 3 by fastening nuts 18 threadedly engaged with the anchor bolts 12. Accordingly, the foundation 3 and the column 1 are joined via the four sets of anchor bolts 12, the joint fittings 30, the joint bolts 13, and the screw members 11. Here, reference numeral 5 denotes an elastic member interposed between the column 1 and the foundation 3, and reference numeral 6 denotes a base fixed to the foundation 3.

Between the column 1 and the foundation 3, out of the four joint fittings 30 arranged in the longitudinal direction of the cross-section of the column 1, the two joint fittings 30*a* arranged on a side closer to the center of the column 1 are arranged such that each joint fitting 30*a* is in proximity to a surface 1*b* in the axial direction inside the cutout portion 1*a* of the column 1. A gap between the joint fitting 30*a* and the surface 1*b* is approximately 1.5 mm. In other words, by providing the cutout portions 1*a* on both ends in the longitudinal direction of the cross-section of the column 1, the center portion of the column 1 protrudes at the end thereof. Side faces of this protruding portion 1*c* face the side faces of the joint fittings 30 in proximity thereto. The gap between the column 1 and the joint fitting 30 can be arbitrarily set in accordance with the purpose, scale, or the like of the structure. The column 1 and the joint fitting 30 may even be in contact with each other.

Figure 4A:
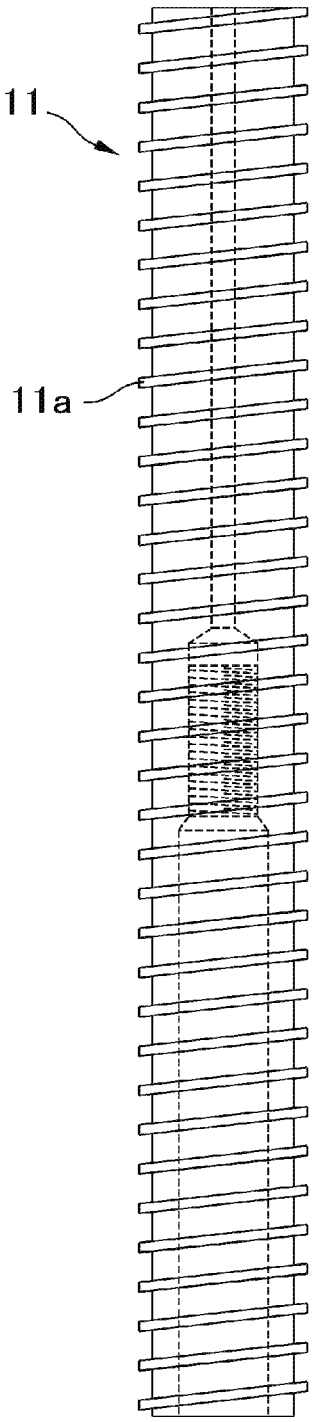
FIG. 4A shows a side view of a screw member that can be used in the joint structure illustrated in FIG. 2 and FIG. 3.
Figure 4B:
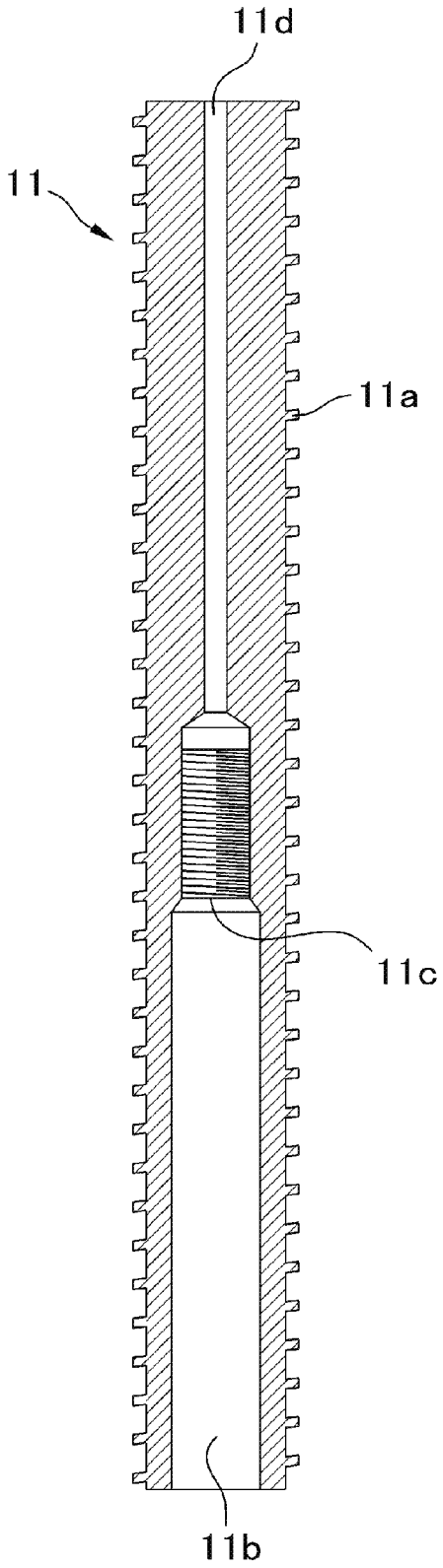
FIG. 4B shows a cross-sectional view of a screw member that can be used in the joint structure illustrated in FIG. 2 and FIG. 3.

As shown in FIG. 4, the screw member 11 is provided with a spirally raised portion 11*a* on an outside surface of a shaft portion made of a rod-shape steel member. The raised portion 11*a* engages with the column 1 in a state where the screw member 11 is threaded into the column 1. Force in the axial direction of the screw member 11 and force in a direction orthogonal to the axis of the screw member 11 are transmitted between the raised portion 11*a* and the column 1. Further, a hollow hole 11*b* is provided in the axial direction from the end face of the screw member 11. An internal thread 11*c* is cut at a bottom portion of the hollow hole 11*b*. The internal thread 11*c* is threadedly engaged with a tip of the joint bolt 13 inserted into the hollow hole 11*b*.

The internal thread 11*c* is provided at the substantially center portion of a total length in the axial direction of the screw member 11. The tip of the joint bolt 13 is threadedly engaged with the substantially center portion in the axial direction of the screw member 11. Accordingly, force transmitted from the raised portion 11*a* provided on the screw member 11 to the column 1 is distributed to a wide range in the axial direction of the screw member 11. Thus, concentration of a large stress on the column 1 can be avoided. Here, reference numeral 11*d* denotes a small hole that penetrates through the screw member from the bottom of the hollow hole 11*b* to an opposite end face of the screw member 11. This small hole provides ease of processing such as anti-corrosion treatment of the screw member 11.

Figure 5:
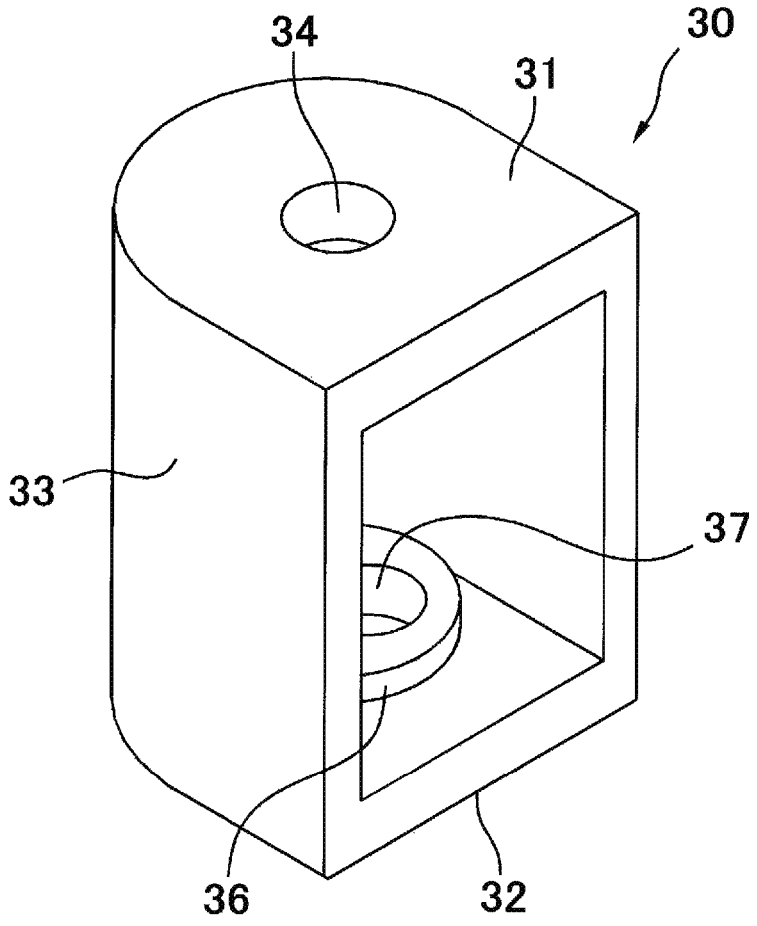
FIG. 5 is a perspective view of a joint fitting that can be used in the joint structure illustrated in FIG. 2 and FIG. 3.

As shown in FIG. 5, the joint fitting 30 is provided with two horizontal plate portions 31, 32 that are opposed to each other and a side plate portion 33 that connects the horizontal plate portions 31, 32. The side plate portion 33 is provided such that a space between these horizontal plates is open at a portion along peripheral edges of the horizontal plates 31, 32.

A bolt hole 34 is provided in an upper-side horizontal plate portion 31. The joint bolt 13 is inserted into the bolt hole 34, and the fastening nut 17 is threadedly engaged with the joint bolt 13 to join the joint bolt 13 and the joint fitting 30.

On the one hand, a lower-side horizontal plate portion 32 faces the upper face of the foundation 3 via the base plate 4. The lower-side horizontal plate portion 32 is fixed to the foundation 3 by the anchor bolt 12 a lower end of which is embedded in the foundation and by the fastening nut 18 threadedly engaged with the anchor bolt.

A circular hole is formed in the lower-side horizontal plate portion 32, and a circular plate 36 is fitted into this circular hole from inside the joint fitting 30 having a box-like shape. Further, the circular plate 36 is rotatable in the circumferential direction in a state where the circular plate 36 is fitted in the circular hole. This circular plate 36 is provided with a slot like oblong hole 37 into which the anchor bolt 12 can be inserted. The oblong hole 37 has an axis in the radial direction from the center of the circular plate 36. Thus, by adjusting a position in the oblong hole 37 through which the anchor bolt 12 is inserted and by rotating the circular plate to adjust the direction of the axis of the oblong hole 37, relative positions of the anchor bolt 12 and the joint fitting 30 can be adjusted. Thus, the column 1 can be easily erected at a predetermined position.

Here, preferably, the joint fitting 30 is set such that a large deformation does not occur when tensile force or compression force is exerted from the column 1 or such that breakage thereof does not occur before facture of the joint bolt 13. Setting of a member thickness and selection of a material is preferably carried out such that the joint fitting 30 has sufficient strength and rigidity.

Figure 6A:
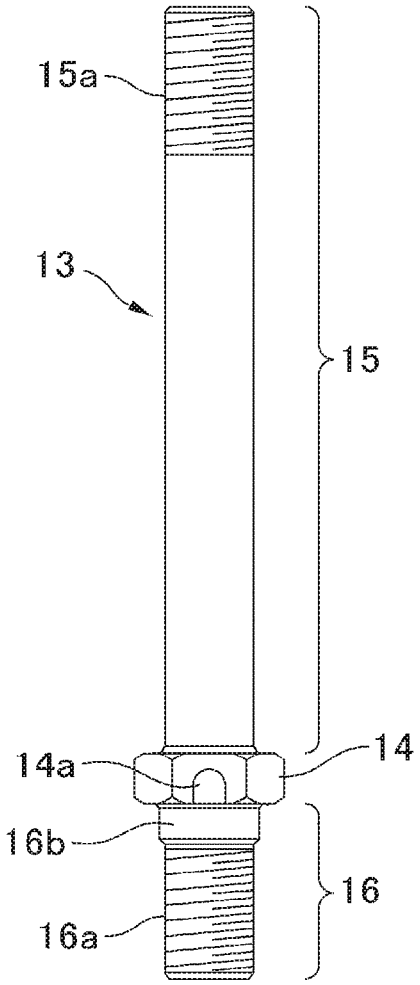
FIG. 6A shows a side view of a joint bolt that can be used in the joint structure illustrated in FIG. 2 and FIG. 3.
Figure 6B:
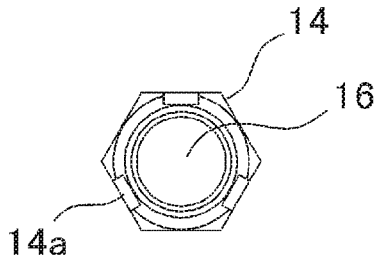
FIG. 6B shows a bottom view of a joint bolt that can be used in the joint structure illustrated in FIG. 2 and FIG. 3.

As shown in FIG. 6, the joint bolt 13 is structured by a flange portion 14, a front shaft portion 15 that protrudes to a forward side from the flange portion 14, and a rear shaft portion 16 that protrudes to a rearward side from the flange portion 14 collinear with the front shaft portion 15. A tip-end external thread (male thread) portion 15*a* is formed on a tip end of the front shaft portion 15 while a rear-end external thread portion 16*a* is formed on a rear end of the rear shaft portion 16.

The tip-end external thread portion 15*a* is threadedly engaged with the internal thread 11*c* formed inside the hollow hole 11*b* of the screw member 11 to join the front shaft portion 15 with the screw member 11. Further, from the tip-end external thread 15*a* to the flange portion 14, an outside diameter of the front shaft portion 15 is formed smaller than an inside diameter of the hollow hole 11*b*. Thus, an outer peripheral surface of the front shaft portion 15 is separated from an inner peripheral surface of the hollow hole 11*b* of the screw member 11. As a result, expansion and contraction of a portion rearward of the tip-end external thread portion 15*a* of the front shaft portion 15 is permitted inside the hollow hole 11*b*.

The flange portion 14 is formed to stretch out laterally from the outer peripheral surface of the front shaft portion 15 or the rear shaft portion 16. By inserting the front shaft portion 15 into the hollow hole 11*b* of the screw member, threading the tip-end external thread portion 15*a* into the internal thread 11*c* provided at the bottom of the hollow hole 11*b*, and tightly fastening thereto, the flange portion 14 is pressed against an end face of the screw member 11. In other words, the tensile force is introduced to a portion between the tip-end external thread portion 15*a* and the flange portion 14 of the joint bolt 13, resulting in generation of elastic elongation deformation.

The rear shaft portion 16 is provided with the rear-end external thread portion 16*a* formed on the rear-end side and an expanded diameter portion 16*b* having a larger diameter than a diameter of the rear-end external thread portion 16*a*.

The rear shaft portion 16 is inserted into the bolt hole 34 provided in the joint fitting 30, and the fastening nut 17 is threadedly engaged with the rear-end external thread portion 16*a*. Further, by sandwiching the upper-side horizontal plate portion 31 of the joint fitting 30 between the flange portion 14 and the fastening nut 17 and then fastening the fastening nut 17, the joint bolt 13 can be coupled with the joint fitting 30. Note that, reference numeral 14*a* denotes a recess for locking a tool from behind the joint bolt 13 and imparting rotational force thereto. Further, reference numeral 16*b* denotes an expanded diameter portion of the rear shaft portion.

The joint bolt 13 is preferably made of a material such as mild steel having a large plastic deformation until fracturing. Material for the joint bolt 13 may be selected and the diameter may be set in accordance with portions to be provided with the joint structure in a structure and with dimensions or the like of the members that constitute the structure.

In such a column end joint structure, when horizontal force acts in the longitudinal direction of the cross-section of the column 1 and the bending moment is generated at the lower end of the column 1, compression force acts from the column 1 on the foundation 3 via the screw member 11 and the joint fitting 30 in the vicinity of one end edge in the longitudinal direction, while the tensile force acts from the screw member 11 on the joint bolt 13, the joint fitting 30, and the anchor bolt 12 in the vicinity of the other end edge in the longitudinal direction. Further, when a degree of tensile stress of the joint bolt 13 exceeds a degree of yield stress, plastic deformation is generated at the front shaft portion 15 of the joint bolt 13. When the tensile force and the compression force repeatedly act on the joint bolt 13 due to earthquake motion and plastic elongation and contraction are generated thereby, energy of the earthquake motion is absorbed by stress-strain hysteresis thereof, and thus vibration of the structure is damped.

On the one hand, shearing force in the horizontal direction, in addition to the bending moment, acts on the lower end of the column 1, and the shearing force is transmitted from the screw member 11 to the foundation 3 via the joint bolt 13 and the joint fitting 30. At this time, force in the horizontal direction acts on the column 1 from a side face of the screw member 11, and force that causes a crack to form in a direction along the screw member is generated in the vicinity of the end of the column. Because the long screws 19 act against such force to control cracking and the four sets of the screw members 11, the joint bolts 13, and the joint fittings 30 are arranged, the horizontal force is transmitted in a distributed manner Thus, splitting is less likely to be generated.

In addition, the splitting is likely to be generated at the position of the screw member 11 threaded into the vicinity of the both ends in the longitudinal direction of the end face of the column 1. When the splitting is generated, the screw member 11 is displaced with respect to the column 1, and a function of bearing the horizontal force is deteriorated. However, even if the splitting is generated in the vicinity of the ends in the longitudinal direction, the horizontal force is transmitted to the joint fitting 30 and the foundation 3 by the screw member 11 arranged on the center side of the column, and thus the displacement of the column 1 is limited to a small value. In addition, when the splitting is generated and the column 1 is displaced, the surface 1*b* in the axial direction inside the cutout portion of the column 1 contacts the joint fitting 30, and thus the displacement of the column 1 is restrained. Further, such a displacement as falling of the joint fitting 30 is also restrained.

Thus, generation of the splitting at the lower end of the column 1 is controlled. Even if the splitting is generated, the column 1 is restrained from being displaced by a large amount. Thus, the resistance until breakage at the joint portion is improved, and displacement until breakage is controlled. Thus, safety of the structure is improved.

Figure 7:
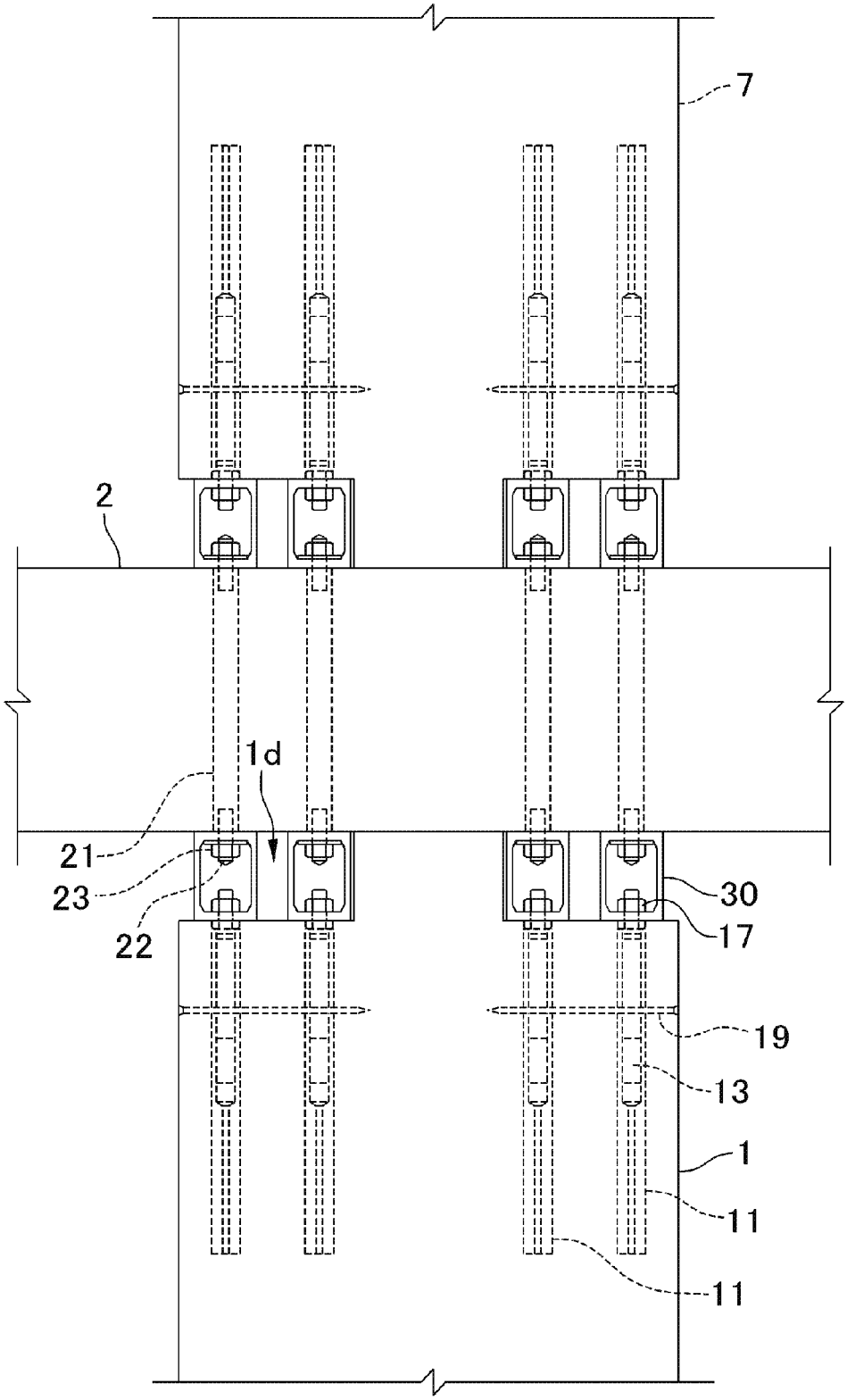
FIG. 7 is a front view, illustrating an example in which the column end joint structure according to an embodiment of the present invention is applied to joining of a column and a beam.

The joint structure described above relates to joining the wooden column 1 to the foundation 3. However, as shown in FIG. 7, the column end joint structure according to an embodiment of the present invention may also be applied to a portion for joining an upper end of the column 1 to the wooden beam 2, or to a portion for joining a lower end of a column 7 of an upper floor to the beam 2, the beam 2 being the joining member in both cases.

In the structure for joining the upper end of the column 1 to the beam 2, a cutout portion 1*d* is provided in each of both ends in the longitudinal direction of an upper end face of the column 1, and the screw member 11 is threaded into the axial direction of the column 1 from inside the cutout portion 1*d*. In addition, the joint fitting 30 is coupled to the column 1 by the joint bolt 13 threaded into the screw member 11. Here, the same screw member 11, the joint bolt 13, the fastening nut 17, and the joint fitting 30 as those shown in FIG. 3 are used, and thus the same components will be denoted by the same reference numerals and description thereof will be omitted.

A screw member 21 for beam is threaded into the beam 2 in the vertical direction at a position substantially on a same line as the screw member 11 threaded into the column 1. A screw hole is pierced in the axial direction from an end face of the screw member 21. Internal threads are cut on an inner peripheral surface of this screw hole, and a headless bolt 22 is threaded into this screw hole. Further, the headless bolt 22 is inserted into a bolt hole provided in the horizontal plate portion of the joint fitting 30, and a threadedly engaged fastening nut 23 is fastened such that the joint fitting 30 is fixed to the screw member 21 for beam threaded into the beam 2. In addition, using the screw member 21 for beam threaded into the beam 2, the column 7 of the upper floor may be joined on top of the beam 2 in a similar manner such that the bending moment is transmittable.

With such a joint structure as well, similar to the case of joining the column 1 to the foundation 3, generation of the splitting in the column 1 by action of the shearing stress can be controlled. Even if the splitting is generated, a relative displacement of the column 1 with respect to the beam 2 can be controlled from becoming large.

Figure 8:
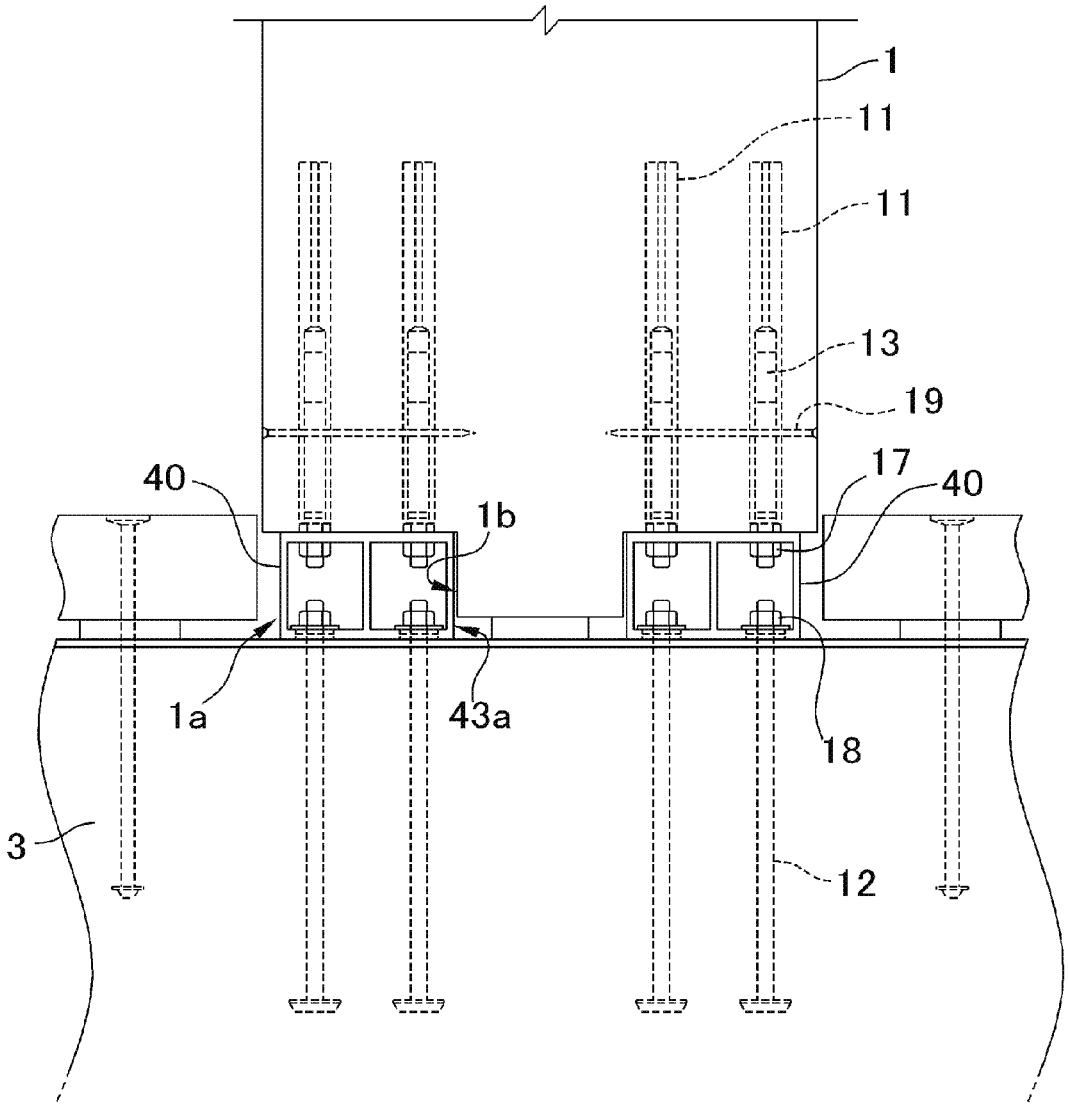
FIG. 8 is a front view, illustrating a column end joint structure according to another embodiment of the present invention.

FIG. 8 shows a front view illustrating a column end joint structure according to another embodiment of the present invention.

In this joint structure, similar to the one shown in FIG. 2, the two cutout portions 1*a* are provided at the end of the column 1, and the four screw members 11 are threaded into the axial direction of the column 1 in a similar manner. Further, different from the joint structure shown in FIG. 2, at the two cutout portions 1*a* provided at the end of the column 1, one joint fitting 40 is fixed to each cutout portion 1*a*. The joint bolt 13 used for fixing has the same joint structure as the one shown in FIG. 2, and the one joint fitting 40 is fixed by the two joint bolts 13 respectively threaded into the two screw members 11.

Figure 9A:
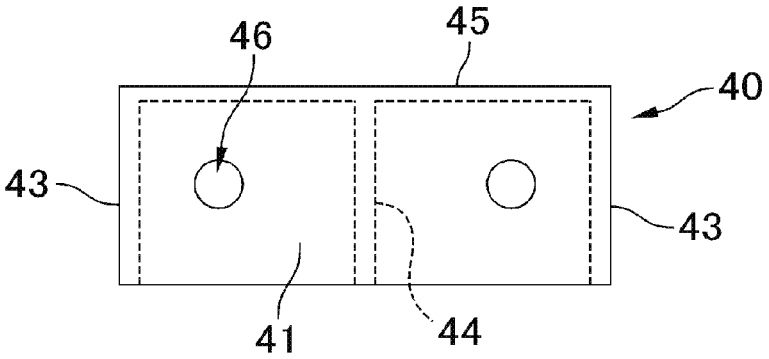
FIG. 9A shows a plan view illustrating a joint fitting used in the column end joint structure illustrated in FIG. 8.
Figure 9B:
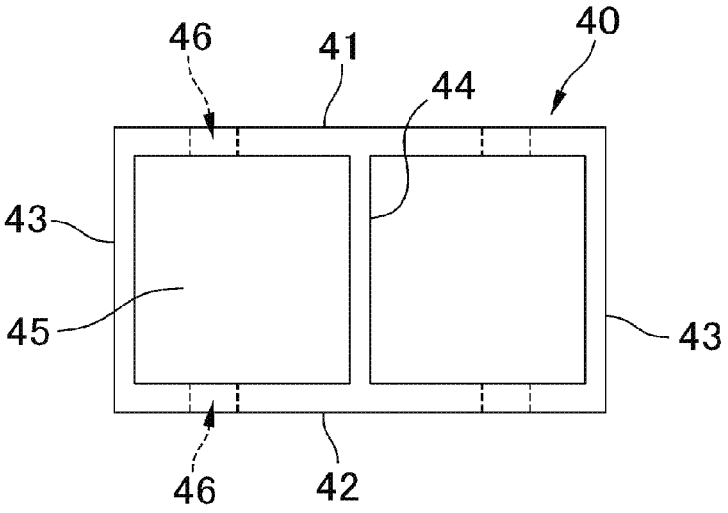
FIG. 9B shows a front view illustrating a joint fitting used in the column end joint structure illustrated in FIG. 8.
Figure 9C:
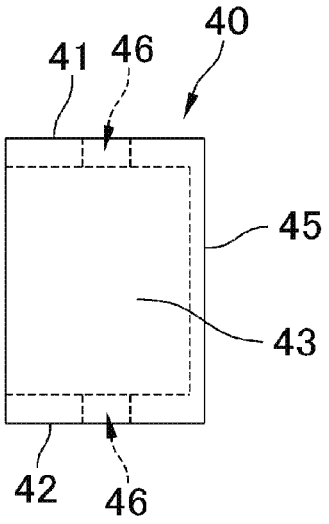
FIG. 9C shows a side view illustrating a joint fitting used in the column end joint structure illustrated in FIG. 8.

As shown in FIGS. 9A, 9B and 9C, the joint fitting 40 used in this joint structure has a rectangular box-like shape, and includes two horizontal plate portions 41, 42 that are opposed to each other, and side plate portions 43, an intermediate plate portion 44, and a back plate portion 45 for connecting these horizontal plate portions 41, 42. The upper and lower horizontal plate portions 41, 42 and the two side plate portions 43, 43 are connected in a box shape. The intermediate plate portion 44 is provided in the vertical direction at the substantially center in the direction of the longer sides of the horizontal plate portions 41, 42 and divides a box-like rectangular internal space into two sections. Further, a rear side of the joint fitting 40 is closed by the back plate portion 45 and a front side thereof is open. From the front opening, the fastening nuts 17, 18 can be fastened to the joint bolt 13 or the anchor bolt 12 by turning. An outer side face of the side plate portion 43*a* located on the center side in the longitudinal direction of the column end face is located so as to closely oppose the surface 1*b* in the vertical direction inside the rectangular cutout portion formed in the column end. A gap between the outer side face and the surface 1*b* may be, for example, approximately 1.5 mm.

On the one hand, this joint fitting 40 is fixed to the foundation 3 by the anchor bolt 12 embedded in the foundation 3, more particularly, the one joint fitting 40 is fixed by the two anchor bolts 12 arranged in the longitudinal direction of the column end face.

In such a joint structure, as to the bending moment that acts on the lower end of the column 1, the tensile force is transmitted from, among the four screw members 11 and the four joint bolts 13 threaded into the screw members 11, the screw member 11 located on one end edge side in the longitudinal direction of the column end face to the joint fitting 40 via the joint bolt 13. Further, the tensile force is transmitted from the joint fitting 40 to the foundation 3. In addition, the compression force is transmitted from the screw member 11 located in the vicinity of the opposite end edge to the foundation 3 via the joint fitting 40.

Further, the shearing force acts on the four screw members 11 and the four joint bolts 13 in a distributed manner such that the splitting of the column 1 is controlled. In addition, even if the splitting is generated along the screw member 11 on the end edge side, the shearing force is transmitted to the joint fitting 40 and the foundation 3 mainly by the screw member 11 and the joint bolt 13 threaded into the center side. Also, while a displacement at the lower end of the column 1 due to the shearing force is increased when the splitting of the column 1 is generated, the vertical surface 1*b* located inside the cutout portion of the column 1 contacts a side face of the joint fitting 40 fixed to the foundation 3 in a stable state by the two anchor bolts 12 to be restrained thereby. As a result, expansion of the displacement can be controlled.

Figure 10A:
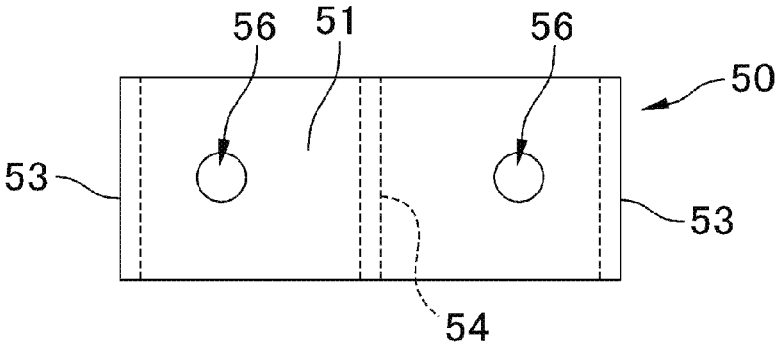
FIG. 10A shows a plan view of a joint fitting that can be used in place of the joint fitting illustrated in FIG. 9A, FIG. 9B and FIG. 9C.
Figure 10B:
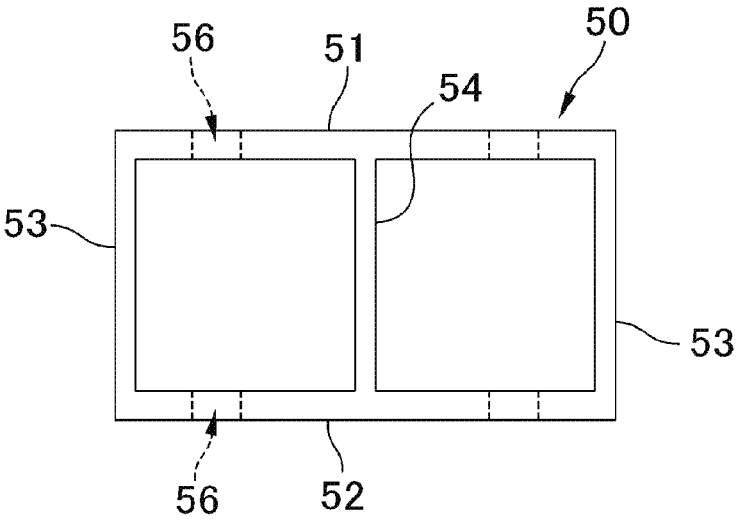
FIG. 10B shows a front view of a joint fitting that can be used in place of the joint fitting illustrated in FIG. 9A, FIG. 9B and FIG. 9C.
Figure 10C:
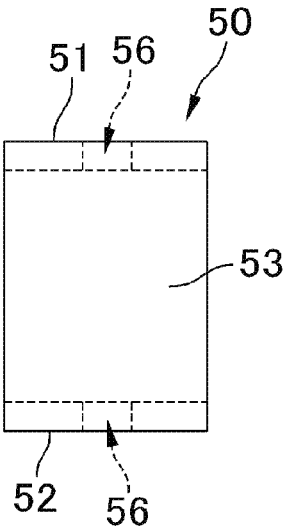
FIG. 10C shows a side view of a joint fitting that can be used in place of the joint fitting illustrated in FIG. 9A, FIG. 9B and FIG. 9C.

While the joint fitting 40 used in the present embodiment includes the back plate portion 45 as shown in FIGS. 9A, 9B and 9C, a joint fitting 50 not including a back plate portion, as shown in FIG. 10, and having a space surrounded by upper and lower horizontal plate portions 51, 52 and side plate portions 53, a front side and a back side of the space being open, may be used. In this joint fitting 50, the upper and lower horizontal plate portions 51, 52 are connected by the two side plate portions 53 and an intermediate plate portion 54 such that one is on the upper side and the other is on the lower side.

The column end joint structure using such joint fittings 40, 50 may be applied to a structure for joining the upper end of the column to the beam or to a structure for joining the lower end of the column onto the beam, similarly to the joint structure shown in FIG. 7.

The joint fittings 40, 50 shown in FIGS. 9A, 9B, 9C and 10 are provided with bolt holes 46, 56 of substantially the same size in the upper and lower horizontal plate portions 41, 42, 51, 52. However, similarly to the joint fitting 30 shown in FIG. 5, circular holes larger than the bolt holes 46, 56 may be provided in one of the upper and lower horizontal plate portions 41, 42, 51, 52 and circular plates, each having an oblong hole, may be fitted in the larger circular holes so as to make a position for inserting the anchor bolt or the joint bolt adjustable.

The present invention is not limited to the embodiments described above, and may be embodied in other forms within the scope of the present invention.

For example, a form of the joint bolt and a joining form of the joint bolt and the screw member may be in other forms such as a form in which a short joint bolt is threaded into a screw hole cut from the end face of the screw member. And, the joining form may be such that a rod-shape member having a hollow hole or a screw hole in the axial direction is embedded into the column and fixed by adhesive or the like, without employing the screw member. Further, the joining form may be such that a joint bolt coupled to a joint fitting is inserted into a hole provided in the axial direction of the column and the joint fitting is fixed by threadedly engaging a nut to a tip end portion inside an intermediate cutout portion provided in the column, without employing the screw member or the rod-shape member. Further, the sizes and the like of the column, the cutout portion of the column, and the joint fitting may also be arbitrarily designed, and shapes and the like of the foregoing may also be arbitrarily designed within the scope of the present invention.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising", "having", "including" and "containing" are to be construed as open-ended terms (i.e., meaning "including, but not limited to") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

DESCRIPTION OF REFERENCE NUMERALS AND SYMBOLS

1: column
1*a*: cutout portion
1*b*: surface in axial direction of column inside cutout portion
1*c*: protruding portion of column end
1*d*: cutout portion
2: beam
3: foundation
3*a*: surface preparation material
4: base plate
5: elastic member
6: base
7: column of upper floor
10: Rahmen frame
11: screw member
11*a*: raised portion
11*b*: hollow hole
11*c*: internal thread
12: anchor bolt
13: joint bolt
14: flange portion of joint bolt
14*a*: recess portion provided in flange portion
15: front shaft portion of joint bolt
15*a*: tip-end external thread portion
16: rear shaft portion of joint bolt
16*a*: rear end external thread portion
16*b*: expanded diameter portion
17, 18: fastening nut
19: long screw
21: screw member for beam
22: headless bolt
23: fastening nut
30: joint fitting
30*a*: joint fitting arranged on a side closer to center of column
31: upper-side horizontal plate portion
32: lower-side horizontal plate portion
33: side plate portion
34: bolt hole
36: circular plate
37: oblong hole (long hole)
40: joint fitting
41: upper-side horizontal plate portion
42: lower-side horizontal plate portion
43: side plate portion
44: intermediate plate portion
45: back plate portion
46: bolt hole
50: joint fitting
51: upper-side horizontal plate portion
52: lower-side horizontal plate portion
53: side plate portion
54: intermediate plate portion
56: bolt hole

What is claimed is:

1. A column end joint structure comprising:
a column made of a flat wooden material having a substantially rectangular cross-section, a length of one side of the column being larger than a length of an adjacent another side of the column;
a joining member to which an end portion of the column is joined;
a plurality of joint fittings for joining the column to the joining member; and
a plurality of joint bolts for coupling the joint fittings to the column;
wherein
a cutout portion is provided in each of both ends in a longitudinal direction of an end face of the column;
the joint fittings are coupled to the column by the joint bolts inserted in an axial direction of the column inside the cutout portion;
the joint fittings are coupled to the joining member;
two of the joint fittings are arranged apart from each other in the longitudinal direction of the end face of the column inside each of the cutout portions;
one of the two joint fittings is located at a position in contact with or close to a surface in the axial direction of the column inside at least one of the cutout portions such that a side face of the joint fitting and the surface in the axial direction of the column inside the at least one of the cutout portions restrain a relative displacement in a direction orthogonal to the axis of the column,
at the end portion of the column, screws are threaded from a short side face of a column cross-section into the longitudinal direction of the cross-section;
a tip of each of the screws passes through a space between the joint bolts and a wider side face of the column and aside by the joint bolts inserted in the axial direction of the column and reaches a position exceeding positions of the joint bolts, and
the tip of each of the screws being pointed so that each of the screws can be self-threaded into the wooden material.

2. A column end joint structure comprising:
a column made of a flat wooden material having a substantially rectangular cross-section, a length of one side of the column being larger than a length of an adjacent another side of the column;
a joining member to which an end portion of the column is joined;
a plurality of joint fittings for joining the column to the joining member;
a plurality of joint bolts for coupling the joint fittings to the column; and
a plurality of screw members,
wherein
a cutout portion is provided in each of both ends in a longitudinal direction of an end face of the column;
the joint fittings are coupled to the column by the joint bolts inserted in an axial direction of the column inside the cutout portion;

the joint fittings are coupled to the joining member;

two of the joint fittings are arranged apart from each other in the longitudinal direction of the end face of the column inside each of the cutout portions;

one of the two joint fittings is located at a position in contact with or close to a surface in the axial direction of the column inside at least one of the cutout portion such that a side face of the joint fitting and the surface in the axial direction of the column inside the at least one of the cutout portion restrain a relative displacement in a direction orthogonal to the axis of the column, each of the screw members has a spiral blade body on an outer peripheral surface of a rod-shape shaft portion and a hole in the axial direction from an end face of the shaft portion;

two of the screw members are threaded into the axial direction of the column from inside each of the cutout portions;

each joint bolt is inserted into the respective hole in each of the respective screw members;

each joint bolt is threaded into an internal thread formed in a bottom portion of each respective hole;

at the end portion of the column, screws are threaded from a short side face of a column cross-section into the longitudinal direction of the cross-section;

a tip of each of the screws passes through a space between the screw member and a wider side face of the column and aside by the joint bolts inserted in the axial direction of the column and reaches a position exceeding positions of the joint bolts; and the tip of each of the screws is pointed so that each of the screws can be self-threaded into the wooden material.

* * * * *